US006211099B1

(12) United States Patent
Hutto, Jr. et al.

(10) Patent No.: US 6,211,099 B1
(45) Date of Patent: Apr. 3, 2001

(54) SUBSTRATE FABRIC

(75) Inventors: Alonzo H. Hutto, Jr., Newberry; Phillip R. Keener, Chapin, both of SC (US)

(73) Assignee: American Fiber & Finishing SC, Inc., Newberry, SC (US)

( * ) Notice: Subject to any disclaimer, the term of this patent is extended or adjusted under 35 U.S.C. 154(b) by 0 days.

(21) Appl. No.: 09/119,992

(22) Filed: Jul. 21, 1998

(51) Int. Cl.[7] ..... D04H 1/00
(52) U.S. Cl. ..... 442/2; 442/220; 428/196
(58) Field of Search ..... 442/208, 209, 442/211, 212, 213, 216, 5, 49, 149, 2, 220; 428/354, 196

(56) References Cited

U.S. PATENT DOCUMENTS

| | | | | |
|---|---|---|---|---|
| 2,860,068 | * | 11/1958 | Griswold | 442/2 X |
| 3,400,004 | * | 9/1968 | Corry | 442/220 X |
| 3,965,943 | * | 6/1976 | Goff, Jr. et al. | 428/208 X |
| 4,069,564 | * | 1/1978 | Trifunovic et al. | 28/273 |
| 4,246,311 | | 1/1981 | Hirst . | |
| 4,303,724 | | 12/1981 | Sergeant et al. . | |
| 4,304,813 | | 12/1981 | Elmore, Jr. . | |
| 4,439,482 | | 3/1984 | Suematsu . | |
| 4,529,655 | * | 7/1985 | Palmer | 428/399 |
| 4,654,254 | | 3/1987 | Gerry et al. . | |
| 4,874,019 | | 10/1989 | Whetsteone . | |
| 4,925,726 | | 5/1990 | Whetstone . | |
| 4,935,293 | | 6/1990 | Whetstone . | |
| 5,014,755 | | 5/1991 | Bompard et al. . | |
| 5,043,208 | | 8/1991 | Whetstone . | |
| 5,047,285 | | 9/1991 | Ward . | |
| 5,184,381 | * | 2/1993 | Coons, III et al. | 28/271 |
| 5,279,891 | | 1/1994 | Ward . | |
| 5,447,787 | | 9/1995 | Shaffer . | |

* cited by examiner

*Primary Examiner*—Daniel Zirker
(74) *Attorney, Agent, or Firm*—Linda M. Buckley

(57) ABSTRACT

Disclosed are loosely woven fabrics formed of multi-filament synthetic warp yarn, wherein the filaments of the multi-filament synthetic warp yarns are tacked at predetermined intervals. These loosely woven fabrics have a variety of uses including but not limited to as substrates for adhesive tapes, fabrics impregnated with wax and other finishes, wall coverings, and laminated fabrics.

22 Claims, No Drawings

SUBSTRATE FABRIC

FIELD OF THE INVENTION

The present invention is directed to loosely woven fabrics formed of multi-filament synthetic warp yarns, wherein the filaments of the multi-filament synthetic warp yarns are tacked at predetermined intervals, and the use of such fabrics as substrates for a variety of products.

BACKGROUND OF THE INVENTION

Loosely woven fabrics have many uses, for example, as substrates or reinforcing fabrics for a variety of end products including adhesive tapes, such as duct tape, athletic tapes, medical tapes, auto-harness wrap tape, and so forth; fabrics impregnated with wax and other finishes, such as tack cloths, bone wrap, ammunition wrap, and so forth; wall coverings used in home and industrial wall decorations; and laminated fabrics used in clothing, shoes, and furniture. Gauzes are one type of loosely woven, open-mesh fabric which are particularly useful as substrates for various adhesive tapes. Open-mesh knit fabrics can also be used as substrates for adhesive tapes. However, where cost is an issue, woven fabrics are preferred because they are less costly to make than knits.

The strength, cost and tearability in use are all properties that are taken into consideration when selecting a substrate or reinforcing fabric for an adhesive tape and the fibers used in constructing the substrate or reinforcing fabric for such tapes will affect all of these properties.

Although gauzes are conventionally prepared from a spun cotton or cotton/synthetic blended yarn, the use of multi-filament synthetic yarns in the manufacture of gauze fabric is highly desirable, because of the strength and cost savings advantages provided by such synthetic yarns over spun yarns. In the case of gauze substrates for adhesive tapes, the use of synthetic yarns would provide gauze having lower yarn count yet adequate strength and tearability. However, because of the natural slickness of synthetic yarns, it has been difficult to prevent fabric weave distortion, and in particular in the low count constructions of gauze fabrics.

In the case of gauze used as a duct tape substrate, fabric constructions and yarn counts with traditional spun yarns have reached the lower limits while providing adequate properties, leaving limited opportunities for further cost reductions. Conventional low end woven duct tape fabric has a construction of 18×8 and uses a spun cotton or polyester/cotton blended yarn in both warp and filling, the yarn counts generally being in the 30/1 to 40/1 range of cotton count. Spun yarn counts lower than 40/1 become too low in strength and/or too expensive for use in duct tape product lines. Fabric constructions such as 18×8 and lower, often perform poorly through the tape making process because of low fabric strength. Furthermore, the tape has poor appearance and poor tear characteristics.

Gauze fabrics including synthetic fibers are known in the art. For example, U.S. Pat. No. 4,303,724 disclosed duct tape incorporating a gauze substrate woven of texturized or false-twist yarns in the filling direction which are continuous filament yarns which have been given increased bulk and loft by the introduction of numerous loops, curls and coil. Texturized yarns perform more like conventional spun yarns. Gauze substrates also incorporating texturized yarns for use in making vinyl products are disclosed in U.S. Pat. Nos. 4,935,293 and 5,043,208. Adhesive tape substrates are disclosed in U.S. Pat. No. 4,654,254 wherein the substrate is a gauze fabric of cotton warp yarn and textured polyester filler yarns U.S. Pat. No. 4,304,813 disclosed warp knit, weft inserted all synthetic continuous filament yarn fabric, preferably polyester, as a substrate for a pressure sensitive adhesive. Even though knit construction provides greater stability when using slick synthetic fibers, a woven construction is less expensive than knit and, thus, highly desirable.

U.S. Pat. No. 4,439,482 disclosed a base fabric for adhesive tapes in which a multi-filament yarn without twists, i.e., a flat yarn, of polyester fibers having a specific residue in molecular chain was used as the warp.

U.S. Pat. No. 5,047,285 disclosed a 100% polyester fabric for use as base fabric for tapes wherein a preferably continuous filament, warp yarn carries a non-hardening agglutinating sizing. Related U.S. Pat. No. 5,279,891 disclosed a woven tape support fabric comprising ribbonized warp yarn processed with agglutinating resin sizing to a specified add-on content.

U.S. Pat. Nos. 4,874,019 and 4,925,726 disclose wall covering substrates formed of texturized, continuous multi-filament yarns having hydrophilic characteristics.

Gauze fabrics comprising synthetic yarns which do not involve preparatory procedures such as texturizing and sizing to achieve lower costs and greater efficiency are being sought.

SUMMARY OF THE INVENTION

It has unexpectedly been found that distortion problems encountered in producing loosely woven fabrics comprising synthetic yarns can be overcome without resorting to preparatory procedures such as texturizing and sizing by using as the warp yarn a multi-filament synthetic yarn which is tacked at predetermined intervals. The tacking provides improved resistance to filament separation, thus, resulting in better weaving performance and fabric quality. The tacking of the filaments of the multi-filament synthetic yarn at predetermined intervals provides sufficient stability to produce superior loosely woven fabrics in the low count gauze fabric constructions without appreciable distortion. Furthermore, the use of such synthetic yarns results in cost savings due to lower cost of the warp yarn and the ability to use lower constructions while minimizing compromise in strength.

DESCRIPTION OF THE INVENTION

The present invention provides a loosely woven fabric which comprises (i) a multi-filament synthetic warp yarn, wherein the filaments of the multi-filament synthetic warp yarn are tacked at predetermined intervals, and (ii) a spun synthetic/cotton blend filling yarn, a spun cotton filling yarn, a texturized filling yarn, or a multi-filament synthetic filling yarn, wherein the filaments of the multi-filament synthetic filling yarn are tacked at predetermined intervals.

In preferred embodiments, the filling yarn comprises a multi-filament synthetic yarn tacked at predetermined intervals or a spun synthetic/cotton blend yarn.

It was unexpectedly found that tacked multifilament yarns for use in the loosely woven fabrics of the present invention have sufficient stability to be used unsized as warp yarn. The quality of the tacks is adequate if they remain essentially intact during the particular weaving process. The stability of such multifilament yarns is influenced by the number of tacks per unit measure. If in the weaving process there are loom stops, yarn breakage, problems with the quality of the fabric, and so forth, believed to relate to the number of tacks per unit measure, the number of tacks per unit measure can be adjusted.

In preferred embodiments of the present invention, the multi-filament synthetic warp or filling yarn is tacked at intervals of from between about 10 to about 40 tacks per meter; preferably at intervals of from between about 15 to about 30 tacks per meter; and more preferably at predetermined intervals of from between about 20 to about 25 tacks per meter. The number of tacks per meter may be the same or different for the warp and filling yarn.

The higher the number of tacks per meter, the more likely it is that the appearance of the fabric will be affected by the tacks. However, this impact of tacks on appearance is acceptable for many products, including but not limited to, most laminated or coated fabrics.

The tacks are preferably formed in the multifilament yarn by heating or by use of compressed air. In particularly preferred embodiments, the tacks are formed in the multifilament yarn by use of compressed air. While not wishing to be bound by theory, it is believed that the air forms tacks by local entangling of the filaments.

Multifilament synthetic yarns tacked at predetermined intervals are standard articles of commerce available from manufactures such as Unifi, Inc., E. I. DuPont de Nemours & Co. ("DuPont"), Warp Technologies, Inc. and Nan Ya Plastics.

In loosely woven fabrics of the present invention, it is preferred that the multi-filament synthetic yarn is a warp drawn yarn or a spun drawn yarn. Warp drawn yarn is particularly preferred for the gauze substrates of the present invention, because of its lower cost and other advantages. For example, multiple ends of yarn can be drawn, tacked, and wound directly onto a beam in a one process operation and the number of ends per beam is limited only to the capacity of the yarn creel and the warp draw process. A multiple of beams can be used to achieve the total number of ends needed for a specific width(s) of fabric on a loom. This capability permits elimination of customary warping and slashing processes used for weaving resulting in cost savings and efficiency. Warp drawn yarns are commercially available from a number of manufacturers such as Unifi, Inc. and Warp Technologies Inc. Warp drawn yarns are prepared from partially oriented yarn (POY) available from manufacturers such as DuPont and NanYa Plastics Corporation of America.

In one preferred embodiment, the loosely woven fabrics of the present invention comprise multi-filament synthetic warp yarns tacked at predetermined intervals in combination with spun cotton, polyester/cotton blends, and textured polyester filling yarns. This combination offers economical and functional advantages over gauze fabrics made of spun yarns.

The present invention will be illustrated by loosely woven fabrics prepared from warp drawn, multi-filament polyester yarn which has been tacked at predetermined intervals. However, any multi-filament synthetic yarn which can be tacked at predetermined intervals is expected to be useful in the practice of the present invention. Warp drawn polyester yarn wherein the filaments are air tacked at predetermined intervals is a preferred yarn for use in the gauze fabrics of the present invention.

The denier of the multi-filament synthetic warp yarn used will depend upon the intended end use but will typically be from between about 30 to about 300 denier and will have from between about 30 to about 70 filaments per strand.

The denier of the warp drawn yarn can be increased to counts like 100 denier for better warp tensile strengths, and possibly greater without significantly increasing tear strength. If tear strength is not a factor, the denier can be increased to 300 and above.

In the case of loosely woven fabrics used as substrates for adhesive tapes, the multi-filament synthetic warp or filling yarn is from between about to about 300 denier or more preferably from between about 70 to about 100 denier.

In preferred embodiments, the loosely woven fabrics of the present invention have a construction wherein the number of warp yarns per inch is from between about 14 up to about 63, more preferably up to about 44 and the number of filling yarns per inch is from between about 6 up to about 54, more preferably up to about 30 are useful. Although fabrics having from about 45 to about 63 warp yarns per inch and from about 31 to about 54 filling yarns per inch are not technically speaking loosely woven fabrics, they are to be included in the term "loosely woven" as used herein, because of their utility as substrates for adhesive tapes and other laminates.

Loosely woven fabrics of the present invention having the number of warp yarns per inch in the range of from between about 20 to about 26 and the number of filling yarns per inch from between about 7 to about 10, are particularly for, e.g., duct tapes.

In loosely woven fabrics of the present invention wherein the filling yarn is cotton, the count is from between about 30/1 to about 40/1; and preferably from between about 35/1 to about 40/1, are particularly useful in all adhesive tapes.

The yarns, number of tacks per unit measure, denier and count of the loosely woven fabrics of the present invention are selected to provide the desired properties for the particular end product.

In loosely woven fabrics of the present invention which are particularly suitable as a substrate or sports or medical tapes, the number of warp yarns per inch is up to about 63 and the number of filling yarns per inch is up to about 54. As mentioned above, these fabrics are not technically loosely woven fabrics. However, they are to be included in the term "loosely woven" as used herein, because of their utility as substrates for adhesive tapes.

The present invention also provides adhesive tapes, particularly duct tapes, which comprise a pliable backing, a substrate or a reinforcing fabric, and a layer of adhesive adherent to said backing material and to said reinforcing fabric, wherein the reinforcing fabric comprises a loosely woven fabric according to the present invention. The loosely woven fabrics of the present invention are particularly useful as substrates for duct tapes.

The loosely woven fabrics of the present invention are especially superior substrates for duct tapes, because their use provides duct tapes having excellent tensile strength, thickness and appearance, as well as desirable tear characteristics.

TENSILE STRENGTH: Tapes sold in the retail market primarily for home use do not require tensile strengths as great as tapes sold in the industrial market for such applications as AC duct wrap. Machine direction tensile strengths generally range from 10 to 45 pounds/inch. Cross direction tensile strengths generally range from 4 to 30 pounds/inch. Strengths are achieved by varying construction, yarn type, and yarn size.

TEAR: Tape is generally torn across the warp yarns, but at times is torn across the filling yarns. Smooth, easy tear is more closely related to the tear characteristics of the individual warp yarns and the close proximity of each warp yarn to each other. Ideal tear characteristic is similar to the smooth action of a zipper.

THICKNESS: The thinner the fabric profile and the more space occupied by the fabric yarns, the less adhesive needed to cover the fabric spaces and surface. However, adequate space between yarns to allow penetration of adhesive through the fabric and attachment of, e.g., a vinyl film, is desirable.

APPEARANCE: The smoother the surface of the fabric and the more perpendicular the warp and filling yarns are to each other, the better the tape appearance.

The major duct tape property which is attributable to the adhesive is adhesive aggressiveness which affects ease of unwind.

The properties of loosely woven fabrics of the present invention can be engineered using the appropriate yarns in proper proportions to form the duct substrate.

Traditional fabric sley counts used in duct tape fabrics of 18 to 44 sley can be readily achieved in the fabrics of the present invention with warp drawn yarns. Since warp drawn yarns can be produced in finer counts like 40 to 70D having higher yields, it is possible to produce a higher sley fabric at lower cost. The higher sley is less subject to weave distortion and the duct tape will have comparably smoother and easier tear characteristics. 70 denier warp drawn polyester yarn is equivalent in weight to a 75.93/1 cotton count yarn and has a strength similar to a 35/1 spun poly/cotton yarn.

Duct tapes for the retail market having substrate constructions of 20×8, 20×25, 24×7, and 24×10 and comprising multi-filament, tacked synthetic warp yarn and open end spun poly/cotton ("OE P/C") filling yarn were prepared as described below. In contrast, duct tape for the industrial market will typically have a construction up to 44 warp ends/inch and 28 filling yarns per inch.

In some preferred embodiments of the present invention, the filling yarn is selected to even further reduce fabric weave distortion in low count constructions. 100% cotton yarns, polyester/cotton yarns in blends from 50/50 to 80/20 and in counts from 31/1 to 39/1 and 1/150 denier can be used to achieve this objective.

A 100% textured polyester yarn with 15–20 tacks per meter is one preferred filling yarn for use in preparing duct tape substrates of the present invention. This filling yarn performed best on the loom and resulted in less weave distortion.

Weaving Process:

The loosely woven fabrics of the present invention are made by conventional methods and systems for forming the same. In such methods and systems care is taken to minimize the stress of the fabric as it is formed to minimize distortion by methods known in the art, e.g., by modification of all surfaces over which the fabric passes from stationary bars to rotating roll which turn very freely to distortion and displacement of filling yarns, reduction of vibrations and so forth. It is highly desirable to modify the loom beam to accept tricot beams in weaving the fabrics of this invention to thereby permit elimination of the slashing process or a beaming operation. The tricot beam is used behind the loom. This result is a cost savings.

Tape Making Process:

Coating and laminating processes are known to be different in technique and application but in the case of duct tape some form of calender is generally used to attach vinyl film of chosen thickness to the fabric substrate of the present invention using an adhesive.

The primary types of coating techniques include not only calendering, but also coating ranges, laminating machines, knife coating and roller coating machines.

The preferred technique for duct tape is a calender which is capable of appropriate speeds.

EXAMPLES

Single 70 denier/34 filaments 100% warp drawn polyester yarn from Unifi Inc. with 20 to 25 air tacks per meter and various fill yarns were used in the manufacture of loosely woven 20 sley and 24 sley fabrics in accordance with the present invention as shown in Table I below. These fabrics were woven on a conventional airjet loom and wound onto a conventional off-loom take-up. The off-loom take-up eliminates the need to seam the fabric as often 30,000 to 50,000 yards without a seam.

| GAUZE FABRICS | | CONSTRUCTION | | FILL[1] | FILL YARN BLEND |
|---|---|---|---|---|---|
| SR-537 | 1 | 59.5" | 24 × 10 | 35 Denier OE P/C | 50/50 P/C |
| SR-545 | 2 | 59.5" | 24 × 7.5 | 31 Denier RS P/C | 65/35 P/C |
| SR-549 | 3 | 59.5" | 24 × 10 | 31 Denier RS P/C | 65/35 P/C |
| SR-564 | 4 | 59.5" | 20 × 7.5 | 35 Denier OE P/C | 80/20 P/C |
| SR-571R | 5 | 59.5" | 20 × 8 | 35 Denier OE P/C | 80/20 P/C |
| SR-573R | 6 | 52" | 24 × 10 | 35 Denier OE P/C | 80/20 P/C |
| SR-576 | 7 | 59.5" | 20 × 25 | 35 Denier OE P/C | 50/50 P/C |
| SR-577 | 8 | 52" | 20 × 10 | 35 Denier OE P/C | 80/20 P/C |
| SR-578 | 9 | 59.5" | 24 × 22 | 35 Denier OE P/C | 80/20 P/C |
| SR-579 | 10 | 59.5" | 24 × 22 | 150 Denier TP | 100% P TEXTURIZED |
| SR-583 | 11 | 60.5" | 20 × 8 | 35 Denier OE P/C | 80/20 P/C |
| SR-585 | 12 | 59.5" | 24 × 8 | 150 Denier TP | 100% P TEXTURIZED & TACKED |

[1]"RS" designates ring spun yarn.
"OE" designates open end spun polyester/cotton yarn.
"TP" designates multi-filament texturized 100% polyester yarn from Unifi. In Sample 10 the TP yarn had 34 filaments and in Sample 12 had 50 filaments and was air tacked.
"P" designates polyester
"P/C" designates polyester/cotton Gauze fabrics 2, 3, 5, and 7 were used to make duct tapes for the retail market having excellent characteristics such as appearance, tear, strength. The duct tapes were made on a calender. The use of 70D multi-filament, warp drawn polyester yarn in these substrates provides a duct tape having zipper-like tear properties.

As is amply illustrated by the various embodiments described herein, by following the teachings of the present invention one of ordinary skill in the art can vary the disclosed loosely woven fabrics and tapes in accordance with the present invention by utilizing ordinary skill in the art to meet the demands of a particular application and situation. Thus, it is understood that the examples and embodiments described herein are for illustrative purposes only and that various modifications or changes in light thereof that will be suggested to persons skilled in the art are to be included in the spirit and purview of this application and the scope of the approved claims.

What is claimed:

1. A loosely woven fabric which comprises (i) a multi-filament synthetic warp yarn, wherein the filaments of the multi-filament synthetic warp yarn are tacked at predetermined intervals, and (ii) a spun synthetic/cotton blend filling yarn, a spun cotton filling yarn, a texturized filling yarn, or a multi-filament synthetic filling yarn, wherein the filaments of the multi-filament synthetic filling yarn are tacked at predetermined intervals.

2. A loosely woven fabric according to claim 1, wherein the multi-filament synthetic warp yarn is tacked at intervals of from between about 10 to about 40 tacks per meter.

3. A loosely woven fabric according to claim 2, wherein the multi-filament synthetic warp yarn is tacked at intervals of from between about 15 to about 30 tacks per meter.

4. A loosely woven fabric according to claim 3, wherein the multi-filament synthetic warp yarn is tacked at predetermined intervals of from between about 20 to about 25 tacks per meter.

5. A loosely woven fabric according to claim 1, wherein the multi-filament synthetic filling yarn is tacked at intervals of from between about 10 to about 40 tacks per meter.

6. A loosely woven fabric according to claim 5, wherein the multi-filament synthetic filling yarn is tacked at intervals of from between about 15 to about 30 tacks per meter.

7. A loosely woven fabric according to claim 6, wherein the multi-filament synthetic filling yarn is tacked at predetermined intervals of from between about 20 to about 25 tacks per meter.

8. A loosely woven fabric according to claim 1, wherein the multi-filament synthetic yarn is a warp drawn yarn or a spun drawn yarn.

9. A loosely woven fabric in accordance with claim 1, wherein the multi-filament synthetic yarn comprises polyester.

10. A loosely woven fabric according to claim 1, wherein the multi-filament synthetic warp yarn is from between about 30 to about 300 denier.

11. A loosely woven fabric according to claim 10, wherein the multi-filament synthetic warp yarn is from between about 70 to about 100 denier.

12. A loosely woven fabric according to claim 10, wherein the number of filaments is from between about 30 to about 70.

13. A loosely woven fabric according to claim 1, wherein the multi-filament synthetic filling yarn is from about 40 to about 300 denier.

14. A loosely woven fabric according to claim 13, wherein the multi-filament synthetic filling yarn is from between about 70 to about 100 denier.

15. A loosely woven fabric according to claim 13, wherein the number of filaments is from between about 30 to about 70.

16. A loosely woven fabric according to claim 1, wherein the number of warp yarns per inch is from between about 14 to about 44 and the number of filling yarns per inch is from between about 6 to about 30.

17. A loosely woven fabric in accordance with claim 16, wherein the number of warp yarns per inch is from between about 20 to about 26 and the number of filling yarns per inch is from between about 7 to about 10.

18. A loosely woven fabric according to claim 1, wherein the synthetic/cotton filling yarn blend ratio is from between about 35/65 to about 80/20.

19. A loosely woven fabric according to claim 18, wherein the synthetic/cotton filling yarn blend ratio is from between about 50/50 to about 80/20.

20. A loosely woven fabric according to claim 1, wherein the cotton filling yarn or synthetic/cotton filling yarn count is from between about 30/1 to about 40/1.

21. A loosely woven fabric according to claim 20, wherein the cotton filling or synthetic/cotton filling yarn count is from between about 35/1 to about 40/1.

22. A tape which comprises a pliable backing, a reinforcing fabric, and a layer of adhesive adherent to said backing material and to said reinforcing fabric, wherein the reinforcing fabric comprises a loosely woven fabric according to any of the preceding claims 1 to 21.

* * * * *